US006367126B1

(12) United States Patent
Rivkin

(10) Patent No.: US 6,367,126 B1
(45) Date of Patent: Apr. 9, 2002

(54) MAGNETIC FORCE EYEGLASS HOLDER

(76) Inventor: Bernard Rivkin, 29 Oak Forest Pl., Santa Rosa, CA (US) 95409

( * ) Notice: Subject to any disclaimer, the term of this patent is extended or adjusted under 35 U.S.C. 154(b) by 0 days.

(21) Appl. No.: 09/535,082

(22) Filed: Mar. 23, 2000

(51) Int. Cl.[7] ..... A44B 21/00; A45F 5/02

(52) U.S. Cl. ..... 24/3.3; 24/10 R; 24/66.1; 24/114.6; 24/303

(58) Field of Search ..... 24/10 R, 3.3, 303, 24/66.1, 3.8, 114.6

(56) References Cited

U.S. PATENT DOCUMENTS

| | | | | | |
|---|---|---|---|---|---|
| 2,319,292 | A | * | 5/1943 | Boggs | 24/303 |
| 2,363,914 | A | * | 11/1944 | Wakefield | 24/303 |
| 2,644,212 | A | * | 7/1953 | Markowitz | 24/303 |
| 3,129,477 | A | * | 4/1964 | Mizuno | 24/303 |
| 3,159,372 | A | * | 12/1964 | McIntosh | 24/303 |
| 3,161,932 | A | * | 12/1964 | Russell | 24/303 |
| 3,178,784 | A | * | 4/1965 | Krauthamer | 24/10 R |
| 4,136,934 | A | | 1/1979 | Seron | 351/157 |
| 4,264,821 | A | * | 4/1981 | Bauer | 250/480 |
| 4,458,384 | A | | 7/1984 | Arnold | 24/3.3 |
| 4,894,887 | A | * | 1/1990 | Ward, II | 24/3.3 |
| 4,969,239 | A | * | 11/1990 | Bruno | 24/3.3 |
| 5,682,648 | A | * | 11/1997 | Miller | 24/303 |
| 5,682,653 | A | * | 11/1997 | Berglof et al. | 24/303 |
| 5,699,990 | A | | 12/1997 | Search | 248/309 |
| 5,794,312 | A | | 8/1998 | O'Mahony | 24/3.3 |
| 5,839,708 | A | | 11/1998 | Search | 248/309 |
| 5,842,613 | A | | 12/1998 | White | 24/3.1 |
| 5,845,369 | A | * | 12/1998 | Dunchock | 24/3.3 |
| 5,860,191 | A | | 1/1999 | Sieger | 24/3.3 |
| 5,864,924 | A | | 2/1999 | Rodriguez | 24/3.3 |
| 5,956,812 | A | | 9/1999 | Moennig | 24/3 |

FOREIGN PATENT DOCUMENTS

| | | | | |
|---|---|---|---|---|
| GB | 1293858 | * | 10/1972 | 24/303 |

* cited by examiner

*Primary Examiner*—Victor N. Sakran
(74) *Attorney, Agent, or Firm*—Johnson & Stainbrook, LLP; Larry D. Johnson; Craig M. Stainbrook

(57) ABSTRACT

A method for holding eyeglasses using a magnetic force means in cooperation with a magnetically saturable keeper element whereby a convenient removable and reusable non-invasive securing system is created which may be used on apparel and other surfaces.

7 Claims, 4 Drawing Sheets

MAGNETIC FORCE EYEGLASS HOLDER

BACKGROUND AND FIELD OF INVENTION

The invention is not a new material, but rather, the discovery of a new and novel solution to a common problem with the use of special materials.

Users of eyewear frequently wish to remove them temporarily. Now comes the problem of where to put them. If you have a pocket to put them in, what else is in the pocket that will scratch the lenses? When you want to retrieve the glasses, which pocket are they in? If you put them down on a table, will you put them down on the frames or on the lenses that may be damaged? Then will you remember to pick them up and not leave them behind? If you have sunglasses or other special glasses as well, that's a whole new set of problems.

The problems outlined above are currently being served in several ways. Cords or chains that attach to the eyeglass temples and are worn around the neck are the most typical present devices. Such devices are disclosed in U.S. Pat. No. 5,956,812 also U.S. Pat. No. 4,136,934 and many others. These are unsatisfactory for many reasons. Namely, when the glasses are being held they are awkward and uncomfortable, especially when the wearer is in motion. If the chain or cord is kept attached to the glasses, it is very uncomfortable while wearing. If you take the chain off and on it is a nuisance and a storage problem, especially if you need the glasses to find and install the temple attachments. Metal and mechanical holders that are fitted in the pocket are awkward and unattractive and tend to pull the pocket down because of the weight of the glasses and the attachment. Some examples are shown in U.S. Pat. Nos. 5,842,613, 56,999,901 5,839,708, 5,864,924, 5,794,312, 5,860,191. Another method shown is the use of a pin attachment, such as in U.S. Pat. No. 4,458,384. This solution is undesirable because it damages the fabric to which it is attached. Adhesive attachment is not satisfactory because the adhesive always leaves a trace that attracts and accumulates dirt.

The present development overcomes all of these objections and provides the utility with an ease of use, inexpensive, attractive and definitely useful solution. To install a holder, one merely places the magnetic element on top of the garment and juxtaposes a keeper underneath that will instantly clamp the holder to the fabric, at which time, the temple of the glasses is inserted in the holding area provided. There is no critical alignment, the attraction is instantaneous and the removal is similarly instantaneous by simply tilting the holder forward while holding the keeper, thus breaking the field of force. The present disclosure takes advantage of a relatively new material called Rare Earth Magnets or Neodymium (NEFEM). This new material has a strength 100 times greater than the steel magnets of last century, while its size is very dramatically reduced. The field of force is so concentrated and powerful that a $1/10^{th}$-oz. disc magnet of Neodymium can hold more than 30 times its weight. Capitalizing on these advantages allows a very small and light holding system for eyewear to be removably attached to the outside of apparel, such as sweaters, coats, aprons, etc., in a very simple, quick method. The reversal of this simple installation procedure removes the holder and makes it available for use thousands of times.

Advantages and Objects

A method for creating a simple to operate, inexpensive to make, non-invasive, removable and reusable eyeglass holder for use on apparel, is shown and described. There are no cords or chains attached to the eyeglasses, which are in the way and uncomfortable when the glasses are worn over the ears. The glasses do not jostle when walking or moving. There are no holes to be made in fine fabrics with the use of pins. There is no dependency on the availability of a pocket or button. When there is a pocket available, hanging a mechanical holder will distort or even damage said pocket. When the need is for two types of eyeglasses, one to wear and one to store temporarily, this system is very functional. Prior art shows all these disadvantages that are eliminated. By using state of the art materials, it is possible, through this invention, to avoid all these negatives. It becomes practical with this method to create a decorative, as well as functional, solution to this universal need.

LIST OF REFERENCE NUMBERS

20—Rare Earth Magnets
22A—Preferred embodiment
22B—Second embodiment

22C—Third embodiment
24—Eyeglass temple piece
26—Garment
28—Keeper plate
30—Tapered edge
31—Alternate style backer plate with magnets
32—Magnet housing
34—Threaded magnet housing
36—Threaded magnet receiver
38—Attaching hole for chain
40—Non-magnetic chain
42—Keeper plate

DETAILED DESCRIPTION OF THE INVENTION

Figure 1:
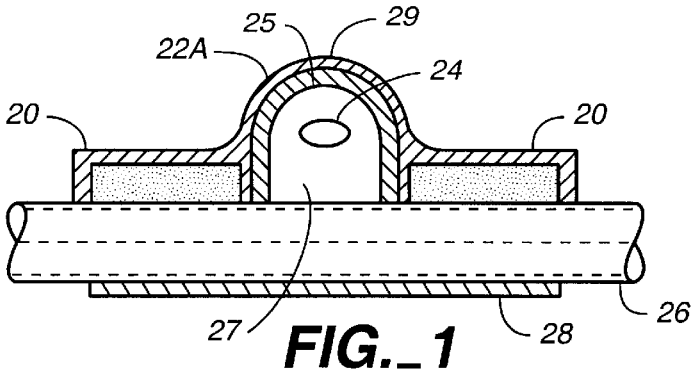
FIG. 1 is a section drawing of the preferred embodiment of the invention secured magnetically to a garment, as seen from the top.
Figure 2:
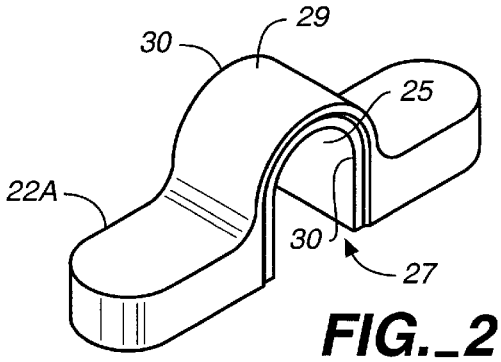
FIG. 2 is a perspective showing of the preferred embodiment showing the tapered edges, for easy eyeglass installation.
Figure 3:
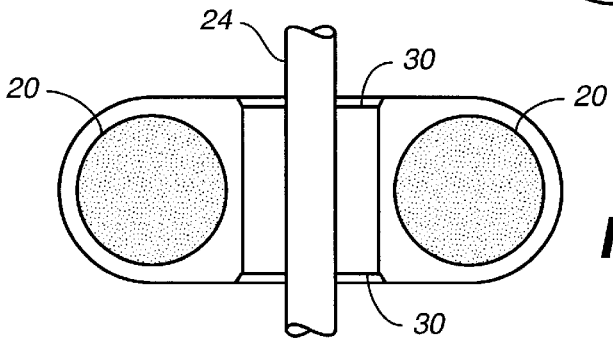
FIG. 3 is an elevation view of the preferred embodiment showing the magnets from the bottom with an eyeglass temple piece showing.
Figure 4:
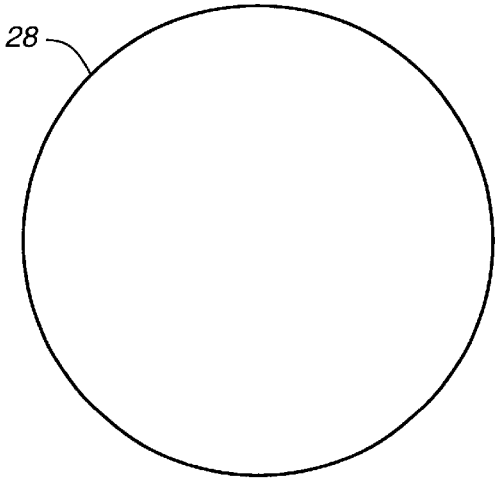
FIG. 4 is a plan view of the basic keeper plate preferably made of Alnico.
Figure 5:
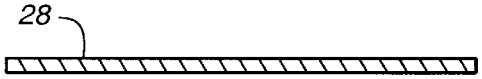
FIG. 5 is a section drawing of the basic keeper plate shown in FIG. 4.

FIG. 1 shows a perspective view of a preferred embodiment of a removable and reusable non-invasive magnetic force eyewear holder for use on clothing or other surfaces. The principle part No. (22A) is a holder that embodies two rare earth magnets (20) mounted on the bottom. No. (28) is a keeper plate preferably made of Alnico. When holder (22A) is placed on the outside of clothing such as a blouse, sweater, jacket, etc., and keeper No. (28) is placed underneath the apparel contiguous in location to the holder, the magnetic force between the magnets (20) and the keeper (28) will clamp the apparel and provide a holding means for eyeglasses.

OPERATION OF THE INVENTION

The operation of a preferred embodiment is, a saddle shaped unit of injection molded plastic (22A) to which two rare earth neodymium magnets (20) are affixed in wells formed to allow for insertion of the magnetic disks and the extra strong adhesive to hold them in place. This holder may be fabricated in other ways using other materials in keeping with the spirit of the embodiment. The keeper (28) in the preferred embodiment is a disk preferably made of Alnico material, that is composed of aluminum, nickel, and cobalt, together with approximately 50% of iron. The advantage of Alnico is its higher saturation capability and lower coercivity. This combination in concert with favorable weight and costing, are the advantages of its use. Keepers can also be made of ferrites or other magnetic saturable materials; however, each has its disadvantages such as the brittleness of ferrite, cost, weight of other materials.

Figure 8:
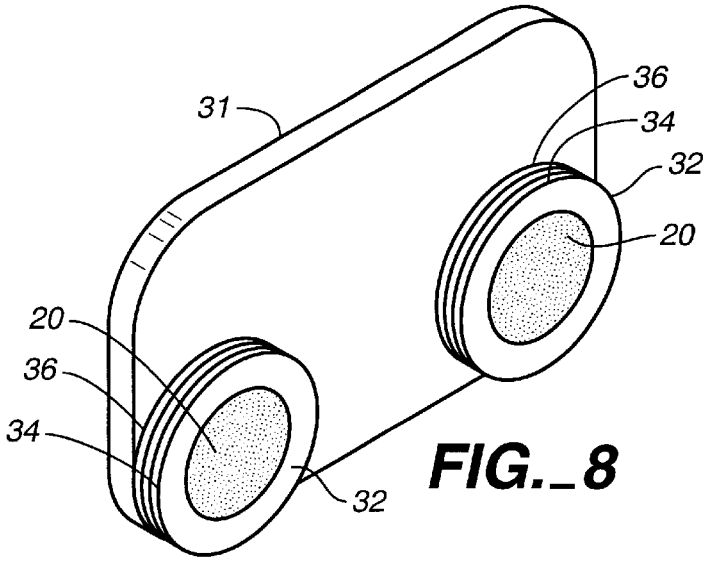
FIG. 8 shows a variation of FIG. 6 where the magnet carriers are movably adjustable.
Figure 9:
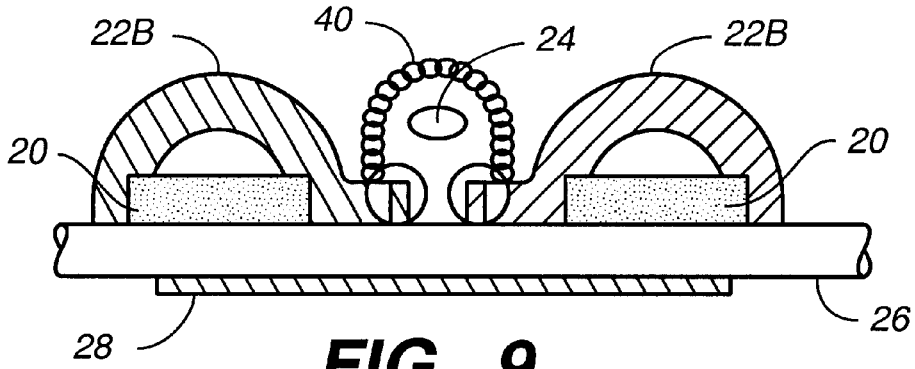
FIG. 9 shows a section of drawing of another embodiment where the loose chain becomes the eyeglass holder, shown attached to a garment, as seen from the top.
Figure 10:
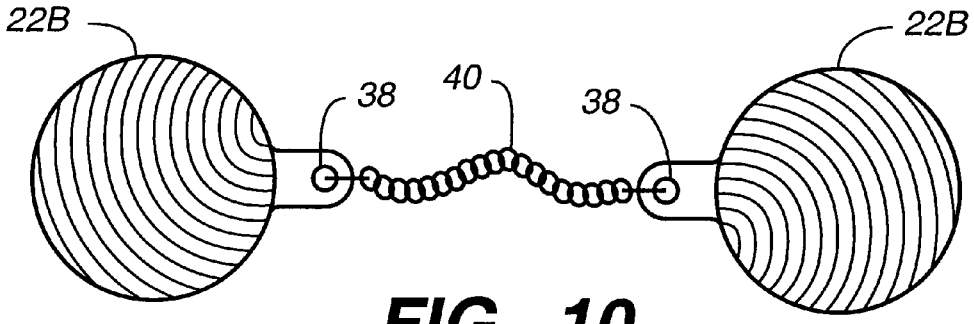
FIG. 10 shows the top plan view of the embodiment shown in FIG. 9 with chain extended and more decorative detail.
Figure 11:
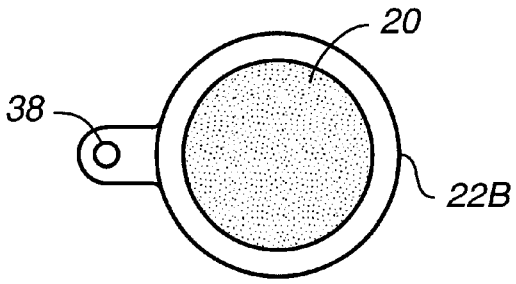
FIG. 11 shows the bottom plan view of a magnet holder as shown in FIG. 9 with attaching hole for the chain.
Figure 12:
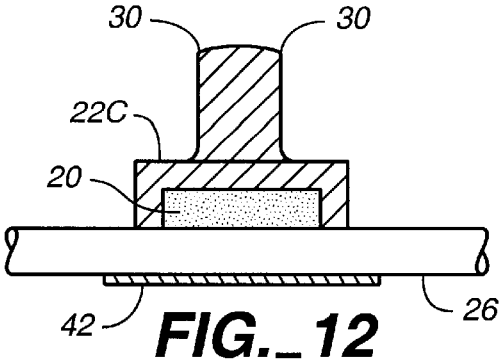
FIG. 12 shows a side section drawing of another embodiment where there is only one magnet, shown attached to a garment, as seen from the top.
Figure 13:
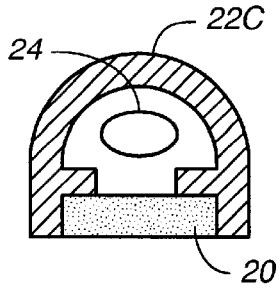
FIG. 13 shows top section drawing of the embodiment shown in FIG. 12 turned 90° C.
Figure 14:
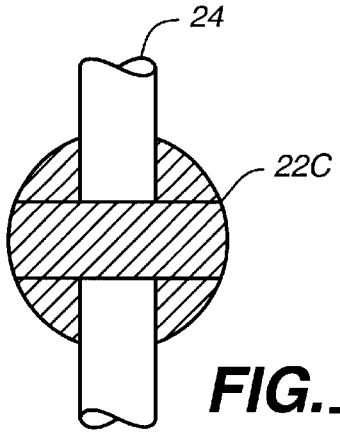
FIG. 14 shows a front plan view of FIG. 12 with an eyeglass temple piece inserted.
Figure 15:
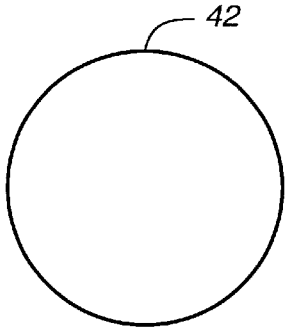
FIG. 15 shows a plan view of a smaller keeper, preferably made of Alnico.
Figure 17:
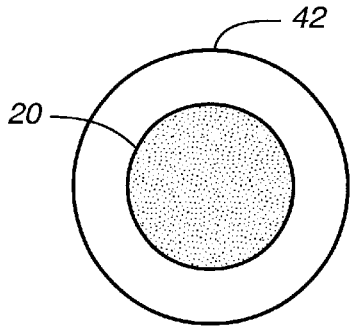
FIG. 17 shows a bottom plan view of another embodiment of the keeper with a magnet attached.
Figure 16:
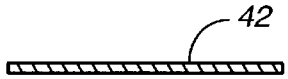
FIG. 16 shows a section drawing of the smaller keeper preferably made of Alnico.
Figure 18:
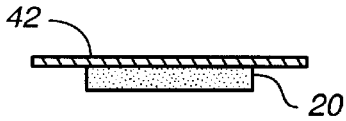
FIG. 18 shows the section view of FIG. 17.

Other species of this invention are shown in (FIG. 9) & (FIG. 12). In FIG. (9) a holder is created with two pieces, each of which has a rare earth magnet enclosed and the two pieces are attached with a chain of non-magnetic material. These parts can be molded or cast or stamped or of semi-precious stones, etc. and will function in the same manner as the preferred embodiment. The advantage of this specie is that it can be made more attractive and decorative by using precious metal or stones. Keepers can be formed with rare earth magnets attached, that may or may not be adjustable (see FIG. 8) & (FIG. 17). The advantage of the keeper with magnets is a multiplication of the force pattern and, therefore, the greater holding strength for heavier apparel or security of the more expensive holder parts. Another species shown in FIG. (12) shows a holder with one rare earth magnet and a formed opening into which eyeglass temple pieces can be inserted. The keeper piece is an appropriately sized, preferably Alnico part, that may also have a rare earth magnet (see FIG. 17) attached for applications where the holder would encounter rough usage.

Attachment of the holder (22C) is effected by bringing it into proximity of the keeper (28) placed underneath the garment. Natural magnetic attraction simplifies the procedure. No skill or training is needed. Removal of the holder requires tilting the holder downward until magnetic force pattern is broken.

CONCLUSIONS, RAMIFICATIONS AND SCOPE OF INVENTION

The reader will see that the removable and reusable non-invasive magnetic force eyewear holder for use on clothing or other surfaces is a highly reliable, lightweight, economical device that can be used by persons of any age. There is no training necessary or special agility required.

While the descriptions contain many specificities, these should not be construed as limitations on the scope of the invention, but rather an exemplification of preferred embodiments thereof. Many other variations are possible and practical to those skilled in the art in keeping with the spirit of this invention. Accordingly, the scope of the invention should be determined not by the illustrated embodiments, but by the appended claims and their legal equivalents. It should be clear that changes in size, smaller or larger, parts made of different shapes and colors and materials can be made without leaving the spirit of the invention. Likewise, it is possible to reconfigure the holding area to satisfy additional end uses. The use of the magnets in the underside piece instead of the outer holder part is also envisioned for certain applications.

Figure 6:
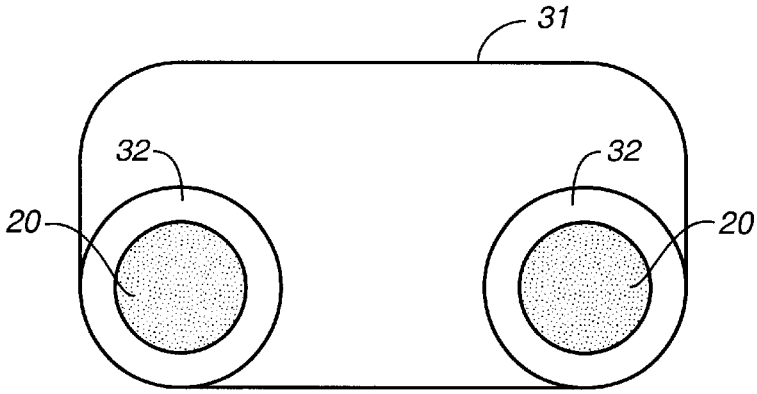
FIG. 6 is an alternate type of keeper plate with two magnets attached.
Figure 7:
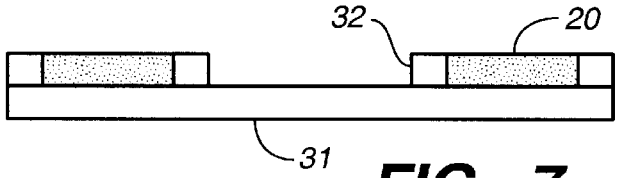
FIG. 7 is a section drawing of the alternate keeper plate shown in FIG. 6 as seen from side.

The preferred embodiment as shown in FIG. 1 is comprised of a magnet carrier (22A) having a bridge (29) formed to create an open holding area (27) in which glasses may be installed, in association with a keeper (28), preferred made of Alnico. The keeper may also be provided with one or more magnets (20) either fixed or adjustable for greater holding power. (FIG. 6) (FIG. 8) & (FIG. 17).

The holder (FIG. 9) may also be made using two holders connected with a chain (FIG. 22B) instead of a single unit (22A). This format lends itself as a fashion jewelry accent since the magnets and keeper are hidden. Holder can be made of precious metal, precious stones, etc., providing a beautiful, functional holder.

The holder is also shown using a single magnet (FIG. 12) & (22C), and a smaller keeper for applications like aprons, autos, etc., or anywhere minimum size is desirable. A more powerful keeper with a magnet attached (FIG. 17) may also be used where more secure anchorage is desirable.

Another extremely valuable attribute of this system, is that the magnetic holder can be attached to almost any metal surface providing a convenient spare pair, at a file cabinet, computer area, desk area or kitchen area, thereby eliminating the need for a keeper.

The rare earth magnets are preferably neodymium (NEFEM). This relatively new material that was developed in 1983, represents the ultimate in magnetization saturation for size and cost. The great magnetic force field that the magnet can produce, therefore, controls how much it can lift or hold. Neomagnets are 10 times more powerful than ferrite magnets and more than 100 times more powerful than the steel magnets of last century. A steel magnet, weighing 16 lbs., may have a 4800 gauss and will lift 250 lbs. of iron. A neodymium disk magnet of approximately 0.500×0.125 and weighing $1/10^{th}$ of one ounce, can generate 2400 gauss and lift 3 lbs The other very valuable attribute of the neodymium magnet, is its very high coercivity, which makes it extremely difficult to de-magnetize. Our preferred embodiment magnets are Nickel-plated to avoid any atmospheric deterioration. Most neodymium magnets are made in Germany, Japan, China and Ireland.

The use of this system does not create any hazard of damage to apparel no matter how delicate or coarse, nor other metal surfaces to which it is attached, and no marking will occur on clothing as in the use of adhesives.

It is anticipated that a double-sided pressure sensitive adhesive foam pad will be provided to attach the keeper to a wood or non-magnetic surface.

It is also anticipated that variations in the size and shape of holding area, together with a foam (25) or other flexible material, may be attached inside the holding area (27) for additional universality of fit for eyeglasses or other small objects weighing less than three pounds.

I claim:

1. A magnetic force eyeglass holder for releasable attachment to a garment, comprising:

two spaced-apart rare earth magnets;

a magnet housing for said rare earth magnets, said magnet housing fixing said magnets in their respective positions, said housing including a bridge interposed between said magnets and their respective positions, said housing including a bridge interposed between said magnets and forming an opening for inserting an eyeglass temple piece; and a magnetically saturable keeper plate.

2. The apparatus of claim 1, wherein said at least one rare earth magnet is made of neodymium.

3. The apparatus of claim 1, wherein said at least one rare earth magnet is nickel coated.

4. The apparatus of claim 1, wherein said magnetically saturable keeper plate is fabricated from Alnico.

5. The apparatus of claim 1, wherein the opening formed by said bridge is filled with deformable foam for securely holding eyeglasses when said apparatus is jostled.

6. A magnetic force eyeglass holder for releasable attachment to a garment, comprising:

two spaced-apart magnets;

a magnet housing for said magnets, said magnet housing fixing said magnets in their respective positions, said housing including a bridge interposed between said magnets and forming an opening for inserting an eyeglass temple piece; and a magnetically saturable keeper plate.

7. The apparatus of claim 6, wherein the opening formed by said bridge is filled with deformable foam for securely holding eyeglasses when said apparatus is jostled.

* * * * *